US005106816A

United States Patent [19]

Morohoshi et al.

[11] Patent Number: 5,106,816

[45] Date of Patent: Apr. 21, 1992

[54] IMAGE RECEIVING MEDIUM FOR USE IN SUBLIMATION-TYPE THERMAL IAMGE TRANSFER RECORDING SYSTEM

[75] Inventors: Naoya Morohoshi; Hiroyuki Uemura; Hidehiro Mochizuki, all of Numazu; Masaru Shimada, Shizuoka; Chiharu Nogawa, Numazu; Yutaka Ariga, Fuji, all of Japan

[73] Assignee: Ricoh Company, Ltd., Tokyo, Japan

[21] Appl. No.: 672,076

[22] Filed: Mar. 19, 1991

[30] Foreign Application Priority Data

Mar. 19, 1990 [JP] Japan ..... 2-67370

[51] Int. Cl.[5] ..... B41M 5/035; B41M 5/26

[52] U.S. Cl. ..... 503/227; 428/195; 428/423.1; 428/447; 428/913

[58] Field of Search ..... 8/471; 428/195, 423.1, 428/913, 914, 336, 447; 503/227

[56] References Cited

U.S. PATENT DOCUMENTS 4,990,485 2/1991 Egashira et al. ..... 503/227

*Primary Examiner*—Bruce H. Hess

*Attorney, Agent, or Firm*—Oblon, Spivak, McClelland, Maier & Neustadt

[57] ABSTRACT

An image receiving medium for use in a sublimation-type image transfer recording system is composed of a support, an intermediate layer containing an isocyanate compound, and a dye-receiving layer containing an active-hydrogen-containing resin, an isocyanate compound and a polyether-modified silicone, which layers are overlaid in this order on the substrate.

10 Claims, 1 Drawing Sheet

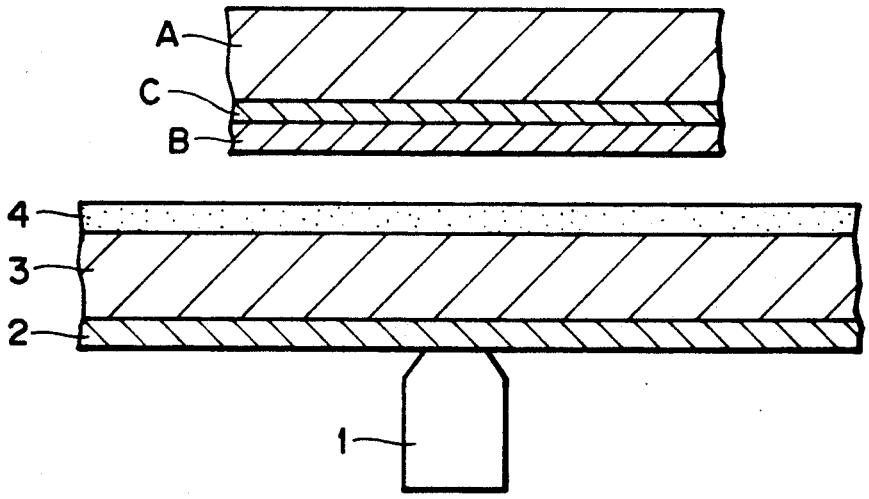
A
C
B
4
3
2
1

IMAGE RECEIVING MEDIUM FOR USE IN SUBLIMATION-TYPE THERMAL IAMGE TRANSFER RECORDING SYSTEM

BACKGROUND OF THE INVENTION

1. Field of the Invention

The present invention relates to an image receiving medium for use in combination with a thermal image transfer recording medium for a sublimation-type thermal image transfer recording system, and more particularly to an image receiving medium for use in a sublimation-type image transfer recording system is composed of a support, an intermediate layer containing an isocyanate compound, and a dye-receiving layer containing an active-hydrogen-containing resin, an isocyanate compound and a polyether-modified silicone, which layers are overlaid in this order on the substrate.

2. Discussion of Background

A sublimation-type thermal image transfer recording system is characterized by employing a thermal image transfer recording medium which comprises a dye-transfer layer containing a heat-sublimable dye, and an image receiving medium capable of receiving the dye which is sublimed when the thermal image transfer recording medium is superimposed on the image receiving medium and heated from the back side thereof. Since the above recording system can produce a full-colored hard copy with an excellent halftone, comparable to a color photograph, it is greatly attracting public attention now.

The conventional image receiving medium for use in the above sublimation-type thermal image transfer recording system is constructed in such a fashion that a dye-receiving layer comprising (i) a thermoplastic resin such as a polyester resin, which can be readily dyed with a heat-sublimable dye, and (ii) a releasing agent is formed on a support such as a sheet of synthetic paper. However, that kind of conventional image receiving medium has the shortcoming that the image receiving medium readily fuses when thermal recording is conducted, and sticks to a thermal image transfer recording medium (for example, a color sheet) because of the low heat-resistance of the polyester resin contained in the image-receiving medium.

To solve the above problem, the releasing agent has been incorporated into a dye-receiving layer of the image receiving medium, so that the releasability of the dye-receiving layer of the image receiving medium from the thermal image transfer recording medium can be improved.

When the amount of the aforementioned releasing agent is small, however, a dye-transfer layer of the thermal image transfer recording medium is peeled off a substrate thereof and transferred to the image receiving medium so far as the adhesion strength between the dye-transfer layer and the substrate is not so high.

On the other hand, when the releasing agent is incorporated in the dye-receiving layer of the image receiving medium in a sufficient amount to improve the releasability of the dye-receiving layer of the image receiving medium from the thermal image transfer recording medium, the adhesion between the support and the dye-receiving layer of the image receiving medium is decreased and the dye-receiving layer is peeled off the support and transferred to the thermal image transfer recording medium after thermal recording.

In addition, since the compatibility of the releasing agent with a resin generally contained in the dye-receiving layer of the image receiving medium is not so high, the transparency of the dye-receiving layer becomes low as the amount of the releasing agent is increased. In particular, a transmission-type image receiving medium, for example, an image receiving sheet for an over head projector is required to have a highly transparent dye-receiving layer. In the case of a reflection-type image receiving medium, as a matter of course, the higher the transparency of the dye-receiving layer, the clearer the images recorded thereon.

SUMMARY OF THE INVENTION

Accordingly, a first object of the present invention is to provide an image receiving medium for use in sublimation-type image transfer recording system, free from the above-mentioned conventional shortcomings, with high heat-resistance and high adhesion strength between a support and a dye-receiving layer thereof.

A second object of the invention is to provide an image receiving medium which can be readily released from the thermal image transfer recording medium after thermal recording.

A third object of the invention is to provide an image receiving medium with high transparency and capable of producing high quality images thereon.

The above-mentioned objects of the present invention can be achieved by an image receiving medium for use in a sublimation-type thermal image transfer recording system, which comprises a support, an intermediate layer, formed thereon, comprising an isocyanate compound, and a dye-receiving layer, formed on the above intermediate layer, comprising an active-hydrogen-containing resin, an isocyanate compound and a polyether-modified silicone.

BRIEF DESCRIPTION OF THE DRAWING

In the drawing, the single figure is a schematic cross-sectional view in explanation of the sublimation-type thermal image transfer recording system employing a thermal image transfer recording medium and an image receiving medium according to the present invention.

DESCRIPTION OF THE PREFERRED EMBODIMENTS

In the image receiving medium according to the present invention for use in a sublimation-type thermal image transfer recording system, an intermediate layer comprising an isocyanate compound is interposed between a support and a dye-receiving layer comprising an active-hydrogen-containing resin, an isocyanate compound and a polyether-modified silicone. Owning to the intermediate layer, the support is not directly affected by the releasing agent incorporated in the dye-receiving layer, so that the adhesion between the dye-receiving layer and the support can be maintained, and at the same time, the releasability of the dye-receiving layer of the image receiving medium from the dye-transfer layer of the thermal image transfer recording medium can be improved.

Referring now to the accompanying drawing, the present invention will now be explained in more detail.

As shown in the single figure, an image receiving medium of the present invention comprises a support A, an intermediate layer C, and a dye-receiving layer B.

In this figure, reference numeral 1 designates a thermal head, and a thermal image transfer recording medium for use in combination with the above image receiving medium comprises a heat-resistant layer 2, a substrate 3 and a dye-transfer layer 4.

When the image receiving medium is superimposed on the thermal image transfer recording medium and the heat is applied to the thermal image transfer recording medium using the thermal head 1, a heat-sublimable dye contained in the dye-transfer layer 4 the thermal image transfer recording medium sublimes and diffuses therein, and is then transferred to the dye-receiving layer B of the image receiving medium. The transferred dye diffuses in the dye-receiving layer B to dye the resin contained therein.

As mentioned previously, it has been conventionally known that a releasing agent such as a silicone oil is incorporated into the dye-receiving layer B of the image receiving medium to prevent the image receiving medium from fusing and sticking to the thermal image transfer recording medium. In this case, when the amount of the releasing agent is small, the dye-receiving layer B cannot be smoothly released from the dye-transfer layer 4 of the thermal image transfer recording medium after thermal recording, and the dye-transfer layer 4 itself is peeled off the substrate 3 and transferred to the dye-receiving layer B.

On the other hand, when a large amount of the releasing agent is incorporated in the dye-receiving layer B in order to enhance the releasability from the dye-transfer layer 4, the adhesion between the support A and the dye-receiving layer B is so much reduced that the dye-receiving layer B is easily peeled off the support A and transferred to the dye-transfer layer 4 of the thermal image transfer recording medium after thermal recording.

In the image receiving medium according to the present invention, the intermediate layer C comprising an isocyanate compound is interposed between the support A and the dye-receiving layer B, so that the support A is not directly affected by the releasing agent contained in the dye-receiving layer B and the adhesion between the support A and the dye-receiving layer B can be maintained. Consequently, the dye-receiving layer B can be prevented from peeling off the support A after thermal recording.

In the dye-receiving layer B of the image receiving medium of the present invention, the polyether-modified silicone oil, serving as a releasing agent, contained therein is highly compatible with the other components such as an active-hydrogen-containing resin and an isocyanate compound. Therefore, light scattering in the dye-receiving layer B (diffusion in the layer) can be avoided, which increases the transparency of the dye-receiving layer B and decreases a haze or haze value thereof.

In addition, since the active-hydrogen-containing resin is cross-linked with the isocyanate compound in the dye-receiving layer B, the heat resistance of the dye-receiving layer B is improved. Therefore, a portion of the dye-receiving layer B to which the thermal energy is applied for thermal recording is scarcely deformed by the thermal energy, thereby preventing the surface smoothness of the dye-receiving layer B from degrading. Consequently, the light diffusion by the surface of the dye-receiving layer B can be decreased, which can contribute to the increase of transparency of the dye-receiving layer B.

In the image receiving medium of the present invention, as noted above, the adhesion between the support A and the dye-receiving layer B is high, the releasability of the dye-receiving layer B from the dye-transfer layer 4 of the thermal image transfer recording medium is favorable after thermal recording, and the transparency of the dye-receiving layer B is increased. As a result, the images formed on the image receiving medium according to the present invention are excellent in quality.

Examples of the isocyanate compounds incorporated in the intermediate layer C and the dye-receiving layer B of the image receiving medium of the present invention are tolylene diisocyanate, hexamethylene diisocyanate, 4,4-diphenylmethane diisocyanate, triphenylmethane triisocyanate, xylylene diisocyanate, methaxylylene diisocyanate, isophorone diisocyanate and bisisocyanate methylcyclohexane. Furthermore, addition products of the above isocyanate compounds with hexanetriol can be employed.

The intermediate layer C of the image receiving medium of the present invention may further comprise a resin and other components. Examples of the resin for use in the intermediate layer C include vinyl chloride resin, vinyl acetate resin, polyamide, polyethylene, polycarbonate, polystyrene, polypropylene, acrylic resin, phenolic resin, polyester, polyurethane, epoxy resin, silicone resin, fluoroplastics, butyral resin, melamine resin, natural rubber, synthetic rubber, polyvinyl alcohol and cellulose resin. These resins can be used alone or in combination In addition, a copolymer thereof can be employed.

Specific examples of the active-hydrogen-containing resin for use in the dye-receiving layer B are polyester resin, polyvinyl chloride resin, polyvinyl butyral, polyvinyl acetal, polyurethane polyol, polyether polyol, polyester polyol, acrylic resin, acryl-polyester copolymer, alkyd resin, silicone polyester, and epoxy resin in which the epoxy groups are opened by alkanolamine to convert into hydroxyl groups.

Examples of the commercially available products of the aforementioned polyester resin are "Vylon RV550", "Vylon RV300", "Vylon RV103", "Vylon RV600", "Vylon RV200", "Vylon PCR939", "Vylon RV220", "Vylon RV280" and "Vylon RV290" (Trademark), made by Toyobo Co., Ltd.; and "Eliter 3600", "Eliter 3200", "Eliter 3201", "Eliter 3210" and "Eliter 3220" (Trademark), made by Unitika Ltd.

As the aforementioned polyvinyl chloride resin containing an active hydrogen, vinyl chloride—vinyl acetate copolymers containing a hydroxyl group (—OH) or a carboxyl group (—COOH) are usable. For example, commercially available products, "VAGH", "VROH", "VMCC" and "VMCH" (Trademark), made by Union Carbide Japan K.K.; and "Denka Vinyl 1000GKT", "Denka Vinyl 1000GK", "Denka Vinyl 1000GKS", "Denka Vinyl 1000C", "Denka Vinyl 1000CK" and "Denka Vinyl 1000CS" Trademark), made by Denki Kagaku Kogyo K.K., can be used.

As for the amount ratio of the active-hydrogen-containing resin to the isocyanate compound in the dye-receiving layer of the image receiving medium, it is preferable that the molar ratio of NCO/OH be in the range of 0.2 to 5.0 in the case where a hydroxyl group is contained in the active-hydrogen-containing resin.

Examples of the polyether-modified silicone include polyether-modified silicone represented by the following formula (1) or (2), epoxy-polyether modified silicone of formula (3), and alkylaralkyl-polyether modified silicone of formula (4).

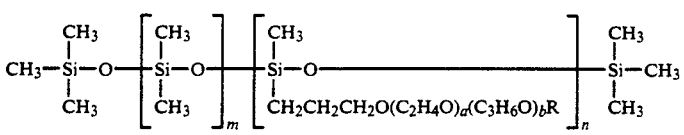

(1)

wherein m and n are integers of 3,000 or less; a and b are integers of 50 or less; and R represents an alkyl group having 8 or less carbon atoms, an aryl group, or an aralkyl group.

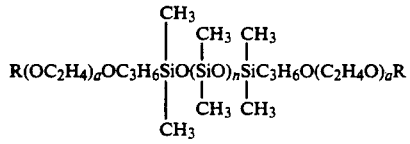

(2)

wherein n is an integer of 3,000 or less; a is an integer of 100 or less; and R represents an alkyl group having 8 or less carbon atoms, an aryl group, or an aralkyl group.

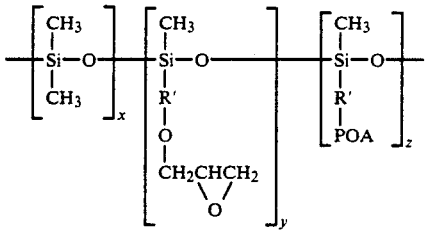

(3)

wherein x is an integer of 3,000 or less; y and z are integers of 2000 or less; R′ represents an alkylene group having 8 or less carbon atoms; and POA represents polyoxyalkylene.

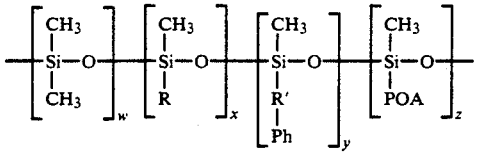

(4)

wherein w is an integer of 3,000 or less; x, y and z are integers of 2,000 or less; R represents an alkyl group having 8 or less carbon atoms, an aryl group, or an aralkyl group; R′ represents an alkylene group having 8 or less carbon atoms; Ph represents a phenyl group; and POA represents polyoxyalkylene.

Examples of the commercially available products of the above polyether-modified silicone are "KF351", "KF352", "KF354", "KF615", "X-22-6008" and "KF-6004" (Trademark), made by Shin-Etsu Chemical Co., Ltd.; and "SH3746", "SH3749", "SF8410", "SF8421" and "SF8419" (Trademark), made by Toray Silicone Co., Ltd.

The incorporation amount of the polyether-modified silicone is preferably in the range of 0.1 to 20 wt. % of the weight of the entire resin contained in the dye-receiving layer.

The dye-receiving layer B and the intermediate layer C of the image receiving medium according to the present invention may further comprise a surface active agent, a ultraviolet absorbing agent, an anti-oxidizing agent and a coloring agent in an appropriate amount.

Examples of materials for the support A of the image receiving medium include synthetic papers such as high quality paper and cellulose fiber paper, coated papers such as art paper, gravure-coated paper and baryta paper, and plastic films. The above materials can be used alone or in combination.

For a support of the transmission-type image receiving medium, the material with a Haze value of 5% or less is preferable. For example, a film of polyethylene terephthalate, polyolefin, polyacryl, polyvinyl chloride and polyvinylidene chloride can be employed. In particular, a polyethylene terephthalate film is preferably used.

It is preferable that the thickness of the intermediate layer C and the dye-receiving layer B of the image receiving medium be in the range of 0.1 to 10 μm, and more preferably in the range of 0.1 to 5 μm.

Other features of this invention will become apparent in the course of the following description of exemplary embodiments, which are given for illustration of the invention and are not intended to be limiting thereof.

EXAMPLE 1

A coating liquid A for forming an intermediate layer and a coating liquid B for forming a dye-receiving layer were separately prepared by thoroughly mixing and dispersing the following components.

| | Parts by Weight |
|---|---|
| [Coating Liquid A] | |
| Polyester resin (Trademark "Vylon 200" made by Toyobo Co., Ltd.) | 100 |
| Isocyanate (Trademark "Burnock DN-950" made by Dainippon Ink & Chemicals, Incorporated) | 10 |
| Toluene | 300 |
| Methyl ethyl ketone | 300 |
| [Coating Liquid B] | |
| Vinyl chloride - vinyl acetate - vinyl alcohol copolymer (Trademark "VAGH" made by Union Carbide Japan K.K.) | 100 |
| Isocyanate (Trademark "Coronate L" made by Nippon Polyurethane Industry Co., Ltd.) | 50 |
| Polyether-modified silicone (Trademark "SH3749" made by Toray Silicone Co., Ltd.) | 5 |
| Toluene | 455 |
| Methyl ethyl ketone | 455 |

The coating liquid A was coated onto the surface of a film of polyethylene terephthalate (Trademark "Lumirror T60" made by Toray Industries, Inc.) serving as a support, with a thickness of about 100 μm by a wire bar, and then dried at 90° C. for one minute, so that an intermediate layer with a thickness of about 3 μm was formed on the polyethlene terephthalate film.

The coating liquid B was coated onto the surface of the above-prepared intermediate layer by a wire bar, and then dried at 90° C. for one minute, so that a dye-receiving layer with a thickness of about 3 μm was formed on the intermediate layer.

Subsequently, the above-laminated material was heated at 60° C. for 10 hours, so that an image receiving medium according to the present invention was obtained.

A thermal image transfer recording medium was prepared by the following method.

A silicone resin layer, serving as a backing layer, with a thickness of about 1 μm was provided on one side of a 6-μm-thick polyethylene terephthalate film.

On the reverse side of the polyethylene terephthalate film, a coating liquid C was coated in a thickness of about 2 μm, so that a dye-transfer layer was provided.

| [Coating Liquid C] | Parts by Weight |
|---|---|
| Polyvinyl butyral (Trademark "BX-1" made by Sekisui Chemical Co., Ltd.) | 7 |
| Polyethylene oxide (Trademark "R-400" made by Meisei Chemical Works, Ltd.) | 3 |
| Heat-sublimable dye (Trademark "Kayaset Blue 714" made by Nippon Kayaku Co., Ltd.) | 15 |
| Toluene | 95 |
| Methyl ethyl ketone | 95 |

The above-prepared image transfer recording medium was superposed on the image receiving medium with the dye-transfer layer of the thermal image transfer recording medium being faced the dye-receiving layer of the image receiving medium. The thermal recording test was performed in such a manner that the thermal energy was applied to the backing layer of the thermal image transfer recording medium by using a thermal head, with the level of the thermal energy changed. The recording density of the thermal head was 6 dots/mm, and the recording output power was 0.42 W/dot.

COMPARATIVE EXAMPLE 1

The procedure for preparation of the image receiving medium as employed in Example 1 was repeated except that the intermediate layer was not formed on the polyethylene terephthalate film and that the coating liquid B for forming the dye-receiving layer used in Example 1 was replaced by a coating liquid D with the following formulation. Thus, a comparative image receiving medium was obtained.

| [Coating Liquid D] | Parts by Weight |
|---|---|
| Vinyl chloride - vinyl acetate copolymer (Trademark "VYHH" made by Union Carbide Japan K.K.) | 100 |
| Amino-modified silicone (Trademark "SF8417" made by Toray Silicone Co., Ltd.) | 1 |
| Toluene | 300 |
| Methyl ethyl ketone | 300 |

The thermal image transfer recording medium which was prepared in the same manner as in Example 1 was superposed on the above-prepared image receiving medium with the dye-transfer layer of the thermal image transfer recording medium being faced the dye-receiving layer of the image receiving medium. The thermal recording test was performed by the same method as in Example 1 using the above thermal image transfer recording medium and image receiving medium.

COMPARATIVE EXAMPLE 2

The procedure for preparation of the image receiving medium as employed in Example 1 was repeated except that the intermediate layer was not formed on the polyethylene terephthalate film and that the coating liquid B for forming the dye-receiving layer used in Example 1 was replaced by a coating liquid E with the following formulation. Thus, a comparative image receiving medium was obtained.

| [Coating Liquid E] | Parts by Weight |
|---|---|
| Vinyl chloride - vinyl acetate copolymer (Trademark "VYHH" made by Union Carbide Japan K.K.) | 100 |
| Amino-modified silicone (Trademark "SF8417" made by Toray Silicone Co., Ltd.) | 5 |
| Toluene | 300 |
| Methyl ethyl ketone | 300 |

The thermal image transfer recording medium which was prepared in the same manner as in Example 1 was superposed on the above-prepared image receiving medium with the dye-transfer layer of the thermal image transfer recording medium being faced the dye-receiving layer of the image receiving medium. The thermal recording test was performed by the same method as in Example 1 using the above thermal image transfer recording medium and image receiving medium.

COMPARATIVE EXAMPLE 3

The procedure for preparation of the image receiving medium as employed in Example 1 was repeated except that the coating liquid B for forming the dye-receiving layer used in Example 1 was replaced by a coating liquid F with the following formulation. Thus, a comparative image receiving medium was obtained.

| [Coating Liquid F] | Parts by Weight |
|---|---|
| Vinyl chloride - vinyl acetate copolymer (Trademark "VYHH" made by Union Carbide Japan K.K.) | 100 |
| Polyether-modified silicone (Trademark "SH3749" made by Toray Silicone Co., Ltd.) | 5 |
| Toluene | 300 |
| Methyl ethyl ketone | 300 |

The thermal image transfer recording medium which was prepared in the same manner as in Example 1 was superposed on the above-prepared image receiving medium with the dye-transfer layer of the thermal image transfer recording medium being faced the dye-receiving layer of the image receiving medium. The thermal recording test was performed by the same method as in Example 1 using the above thermal image transfer recording medium and image receiving medium.

COMPARATIVE EXAMPLE 4

A coating liquid G for forming a dye-receiving layer was prepared by thoroughly mixing and dispersing the following components.

| [Coating Liquid G] | Parts by Weight |
|---|---|
| Vinyl chloride - vinyl alcohol copolymer (Trademark "S-Lec A" made by Sekisui Chemical Co., Ltd.) | 100 |
| Isocyanate (Trademark "Coronate L" made by Nippon Polyurethane Industry Co., Ltd.) | 6 |
| Amino-modified silicone (Trademark "KF-393" made by Shin-Etsu Chemical Co., Ltd.) | 2.5 |
| Toluene | 140 |
| Methyl ethyl ketone | 240 |

The coating liquid G was coated onto the surface of a film of polyethylene terephthalate (Trademark "Lumirror T60" made by Toray Industries, Inc.) with a thickness of about 100 μm by a wire bar, and then dried at 90° C. for one minute, so that a dye-receiving layer with a thickness of about 6 μm was formed on the polyethylene terephthalate film.

Subsequently, the above-laminated material was heated at 60° C. for 10 hours, so that a comparative image receiving medium was obtained.

The thermal image transfer recording medium which was prepared in the same manner as in Example 1 was superposed on the above-prepared image receiving medium with the dye-transfer layer of the thermal image transfer recording medium being faced the dye-receiving layer of the image receiving medium. The thermal recording test was performed by the same method as in Example 1 using the above thermal image transfer recording medium and image receiving medium.

COMPARATIVE EXAMPLE 5

A coating liquid H for forming an intermediate layer and a coating liquid I for forming a dye-receiving layer were separately prepared by thoroughly mixing and dispersing the following components.

| | Parts by Weight |
|---|---|
| [Coating Liquid H] | |
| Polyester resin (Trademark "Vylon 200" made by Toyobo Co., Ltd.) | 100 |
| Isocyanate (Trademark "Burnock DN-950" made by Dainippon Ink & Chemicals, Incorporated) | 7 |
| Toluene | 800 |
| Methyl ethyl ketone | 200 |
| [Coating Liquid I] | |
| Polyester resin (Trademark "Vylon 290" made by Toyobo Co., Ltd.) | 100 |
| Amino-modified silicone (Trademark "KF-393" made by Shin-Etsu Chemical Co., Ltd.) | 2.5 |
| Epoxy-modified silicone (Trademark "KF-100T" made by Shin-Etsu Chemical Co., Ltd.) | 2.5 |
| Toluene | 180 |
| Methyl ethyl ketone | 180 |
| Cyclohexanone | 60 |

The coating liquid H was coated onto the surface of a film of polyethylene terephthalate (Trademark "Lumirror T60" made by Toray Industries, Inc.) with a thickness of about 100 μm by a wire bar, and then dried at 90° C. for one minute, so that an intermediate layer with a thickness of about 1 μm was formed on the polyethylene terephthalate film.

The coating liquid I was coated onto the surface of the above-prepared intermediate layer by a wire bar, and then dried at 90° C. for one minute, so that a dye-receiving layer with a thickness of about 6 μm was formed on the intermediate layer.

Subsequently, the above-laminated material was heated at 60° C. for 10 hours, so that a comparative image receiving medium was obtained.

The thermal image transfer recording medium which was prepared in the same manner as in Example 1 was superposed on the above-prepared image receiving medium with the dye-transfer layer of the thermal image transfer recording medium being faced the dye-receiving layer of the image receiving medium. The thermal recording test was performed by the same method as in Example 1 using the above thermal image transfer recording medium and image receiving medium.

EXAMPLE 2

The procedure for preparation of the image receiving medium as employed in Example 1 was repeated except that the coating liquid B for forming the dye-receiving layer used in Example 1 was replaced by a coating liquid J with the following formulation. Thus, an image receiving medium according to the present invention was obtained.

| [Coating Liquid J] | Parts by Weight |
|---|---|
| Polyester resin (Trademark "Vylon 200" made by Toyobo Co., Ltd.) | 100 |
| Isocyanate (Trademark "Coronate L" made by Nippon Polyurethane Industry Co., Ltd.) | 15 |
| Polyether-modified silicone (Trademark "SH3746" made by Toray Silicone Co., Ltd.) | 5 |
| Toluene | 320 |
| Methyl ethyl ketone | 320 |

The thermal image transfer recording medium which was prepared in the same manner as in Example 1 was superposed on the above-prepared image receiving medium with the dye-transfer layer of the thermal image transfer recording medium being faced the dye-receiving layer of the image receiving medium. The thermal recording test was performed by the same method as in Example 1 using the above thermal image transfer recording medium and image receiving medium.

The results of the thermal recording tests are shown in Table 1.

TABLE 1

| Example No. | Releasability (*) | Adhesion (**) | Haze Value % (***) | Glossiness of Images % (****) |
|---|---|---|---|---|
| Ex. 1 | Rank 1 | ○ | 1.5 | 87.4 |
| Comp. Ex. 1 | Rank 4 | x | 4.0 | — |
| Comp. Ex. 2 | Rank 3 | x | 9.8 | 46.0 |
| Comp. Ex. 3 | Rank 2 | ○ | 2.2 | 40.9 |
| Comp. Ex. 4 | Rank 3 | ○ | 11.2 | 62.6 |
| Comp. Ex. 5 | Rank 3 | ○ | 4.8 | 39.1 |
| Ex. 2 | Rank 1 | ○ | 1.3 | 72.2 |

(*) Releasability of the dye-receiving layer of the image receiving medium from the dye-transfer layer of the thermal image transfer recording medium after thermal recording.
Rank 1: The dye-receiving layer was not fused and the releasability was excellent.
Rank 2: The dye-receiving layer was not fused and the releasability was good.
Rank 3: The releasability was slightly poor.
Rank 4: The image receiving medium was fused and stuck to the thermal image transfer recording medium.
(**) Adhesion between the support and the dye-receiving layer of the image receiving medium. ○: satisfactory adhesion x: unsatisfactory adhesion
(***) The Haze value of the background of the image receiving medium, measured by a commercially available apparatus "Digital Haze Computer HGM-2DP" (Trademark), made by Suga Test Apparatus Co., Ltd.
(****) The image formation was performed with the thermal energy of 3.46 mJ applied to the thermal image transfer recording medium. The glossiness of the obtained image was measured on the dye-receiving layer of the image receiving medium at an angle of 60°.

As can be seen from the results as shown in Table 1, the dye-transfer layer of the thermal image transfer recording medium is not transferred to the dye-receiving layer of the image receiving medium after thermal recording. At the same time, the the dye-receiving layer is not peeled off the support of the image receiving medium and not transferred to the dye-transfer layer of the thermal image transfer recording medium. The releasability of the dye-receiving layer of the image receiving medium from the dye-transfer layer of the thermal image transfer recording medium after thermal recording is thus remarkably improved.

In addition, the Haze value of the background of the dye-receiving layer is low. This means the transparency of the dye-receiving layer of the image receiving medium is high and the image density of the obtained images can be increased. Therefore, the image quality becomes excellent.

Particularly in the present invention, owing to the polyether-modified silicone contained in the dye-receiving layer of the image receiving medium, the extreme slippage of the dye-receiving layer of the image receiving medium is not caused, so that the generation of static electricity can be prevented. Consequently, the image receiving medium according to the present invention can be smoothly transported and writing thereon can also be done smoothly.

What is claimed is:

1. An image receiving medium for use in a sublimation-type image transfer recording system, comprising a support, an intermediate layer comprising an isocyanate compound, and a dye-receiving layer comprising an active-hydrogen-containing resin, an isocyanate compound and a polyether-modified silicone, which layers are overlaid in this order on said substrate.

2. The image receiving medium as claimed in claim 1, wherein said isocyanate compound contained in said intermediate layer and said dye-receiving layer is selected from the group consisting of tolylene diisocyanate, hexamethylene diisocyanate, 4,4-diphenylmethane diisocyanate, triphenylmethane triisocyanate, xylylene diisocyanate, methaxylylene diisocyanate, isophorone diisocyanate and bisisocyanate methylcyclohexane, and addition products of said isocyanates with hexanetriol.

3. The image receiving medium as claimed in claim 1, wherein said intermediate layer further comprises a resin selected from the group consisting of vinyl chloride resin, vinyl acetate resin, polyamide, polyethylene, polycarbonate, polystyrene, polypropylene, acrylic resin, phenolic resin, polyester, polyurethane, epoxy resin, silicone resin, fluoroplastics, butyral resin, melamine resin, natural rubber, synthetic rubber, polyvinyl alcohol and cellulose resin.

4. The image receiving medium as claimed in claim 1, wherein said active-hydrogen-containing resin contained in said dye-receiving layer is selected from the group consisting of polyester resin, polyvinyl chloride resin, polyvinyl butyral resin, polyvinyl acetal resin, polyurethane polyol resin, polyether polyol resin, polyester polyol resin, acrylic resin, acrylpolyester copolymer resin, alkyd resin, silicone polyester resin, and epoxy resin in which the epoxy groups thereof are opened by alkanolamine to convert into hydroxyl groups.

5. The image receiving medium as claimed in claim 1, wherein said polyether-modified silicone contained in said dye-receiving layer is selected from the group consisting of a polyether-modified silicone of formula (1) or (2), an epoxypolyether modified silicone of formula (3), and an alkylaralkyl-polyether modified silicone of formula (4):

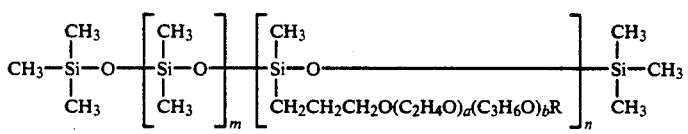

(1)

wherein m and n are integers of 3,000 or less; a and b are integers of 50 or less; and R represents an alkyl group having 8 or less carbon atoms, an aryl group, or an aralkyl group;

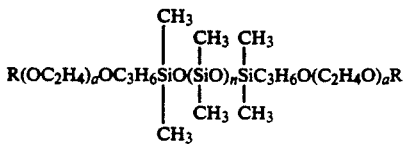

(2)

wherein n is an integer of 3,000 or less; a is an integer of 100 or less; and R represents an alkyl group having 8 or less carbon atoms, an aryl group, or an aralkyl group;

(3)

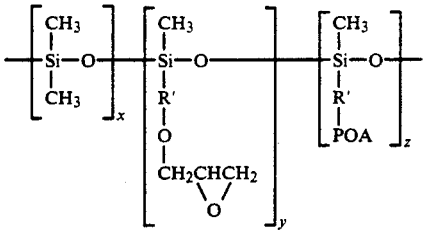

wherein x is an integer of 3,000 or less; y and z are integers of 2000 or less; R′ represents an alkylene group having 8 or less carbon atoms; and POA represents a polyoxyalkylene; and (4)

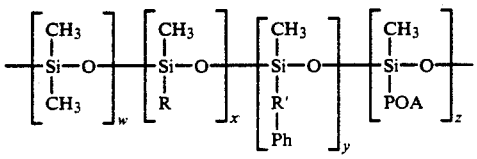

wherein w is an integer of 3,000 or less; x, y and z are integers of 2,000 or less; R represents an alkyl group having 8 or less carbon atoms, an aryl group, or an aralkyl group; R′ represents an alkylene group having 8 or less carbon atoms; Ph represents a phenyl group; and POA represents polyoxyalkylene.

6. The image receiving medium as claimed in claim 1, wherein said polyether-modified silicone is in an amount in the range of 0.1 to 20 wt. % of the weight of entire resin contained in said dye-receiving layer.

7. The image receiving medium as claimed in claim 1, wherein the molar ratio of said active-hydrogen-containing resin to said isocyanate compound in said dye-receiving layer is in the range of 0.2 to 5.0 in terms of NCO/OH.

8. The image receiving medium as claimed in claim 1, wherein said dye-receiving layer and said intermediate layer further comprise at least one component selected from the group consisting of a surface active agent, a ultraviolet absorbing agent, an anti-oxidizing agent and a coloring agent in an appropriate amount.

9. The image receiving medium as claimed in claim 1, wherein said intermediate layer has a thickness of 0.1 to 10 μm.

10. The image receiving medium as claimed in claim 1, wherein said dye-receiving layer has a thickness of 0.1 to 10 μm.

* * * * *

UNITED STATES PATENT AND TRADEMARK OFFICE

CERTIFICATE OF CORRECTION

PATENT NO. : 5,106,816

DATED : APRIL 21, 1992

INVENTOR(S) : NAOYA MOROHOSHI ET AL

It is certified that error appears in the above-identified patent and that said Letters Patent is hereby corrected as shown below:

ON THE TITLE PAGE

Item [54], in the Title, change "IAMGE" to --IMAGE--.

Column 1, line 3, in the Title, change "IAMGE" to --IMAGE--.

Column 11, line 32, after "time,", delete "the".

Signed and Sealed this

Tenth Day of August, 1993

*Attest:*

Michael K. Kirk

MICHAEL K. KIRK

*Attesting Officer*

*Acting Commissioner of Patents and Trademarks*